United States Patent [19]

Halliday et al.

[11] Patent Number: 4,966,077

[45] Date of Patent: Oct. 30, 1990

[54] LOADING OF BOREHOLES WITH EXPLOSIVE

[75] Inventors: Pieter S. Halliday, Randburg; Gareth Tucker, Germiston; Carl H. Lübbe, Kempton Park; Alan J. Harris, Knoppieslaagte; David G. Russell, Johannesburg, all of South Africa

[73] Assignee: AECI Limited, Johannesburg, South Africa

[21] Appl. No.: 340,765

[22] Filed: Apr. 20, 1989

[30] Foreign Application Priority Data

Apr. 21, 1988 [ZA] South Africa ..... 88/2874

[51] Int. Cl.[5] ..... F42B 3/00

[52] U.S. Cl. ..... 102/313; 102/312; 86/20.15

[58] Field of Search ..... 102/312, 313; 86/20.15

[56] References Cited

U.S. PATENT DOCUMENTS 4,195,548 4/1980 Cook et al. ..... 149/109.6
4,510,958 4/1985 Coursen ..... 149/108.8
4,572,075 2/1986 Day et al. ..... 102/313
4,585,496 4/1986 Honeyman et al. ..... 102/313

*Primary Examiner*—Peter A. Nelson
*Attorney, Agent, or Firm*—Cushman, Darby & Cushman

[57] ABSTRACT

A positive displacement explosive base dosing pump is provided with a drive motor 14 and has an outlet 22 connected via a flexible hose 24 to a lance 70. The lance 70 has a mixing device 72 therein and a reciprocable positive displacement gassing solution dosing pump has an outlet connected via a flexible conduit 54 to the lance and feeding into the lance upstream of the mixing device 72. The invention involves using the base dosing pump 12 to pump explosive base from a supply 78 along the hose 24 to the lance 70 while the gassing solution dosing pump 16 simultaneously pumps gassing solution from a supply 56 along the flexible conduit 54. The conduit 54 leads the solution into the lance 70 upstream of the mixing device 72 whereby the explosive base is mixed with the solution, so that a mixture issues from the lance 70 which become sensitized after reaction has taken place between the base and solution.

7 Claims, 3 Drawing Sheets

LOADING OF BOREHOLES WITH EXPLOSIVE

This invention relates to the loading of boreholes with explosive. More particularly it relates to a mobile apparatus for loading a sensitized explosive of the slurry or emulsion type into a borehole; and it relates to a method of loading a sensitized explosive of the slurry or emulsion type into a borehole, particularly a small diameter [21–50 mm] borehole.

According to one aspect of the invention there is provided a mobile apparatus for loading a sensitized explosive of the slurry or emulsion type into a borehole, the apparatus comprising

- a reciprocable positive displacement explosive base dosing pump having an inlet for explosive base;
- a drive motor drivingly connected to the pump;
- a flexible hose connected to an outlet of the dosing pump;
- a lance connected to the end of the hose remote from the pump;
- a mixing device mounted in the lance for subjecting fluid passing therethrough to mixing and shear;
- a reciprocable positive displacement chemical gassing solution dosing pump having an inlet for chemical gassing solution, the gassing solution pump being operatively connected to the base pump for synchronous operation therewith; and
- a flexible conduit connected to an outlet of the gassing solution pump and leading to the lance into which it feeds at a position upstream of the mixing device.

By 'mobile' is meant that the apparatus, particularly when not charged with explosive base or gassing solution as described hereunder, can be manually moved from place to place over the surface of the ground by a single person. Indeed the apparatus, when empty, may be portable, so that it can be lifted by a single person or at most two persons.

The drive motor may be a fluid-driven motor, e.g. an air [pneumatic] motor for connection to a compressed air power supply, or a hydraulic motor for connection e.g. to a power supply comprising a source of water or hydraulic fluid under pressure. Thus, an air motor may be used of a type operable by compressed air supply at a pressure of 200–700 kPa; and it may have a piston and cylinder construction whereby the compressed air supply causes a piston to reciprocate in a cylinder in the air motor, the air motor providing a power output in the form of a piston rod which reciprocates in use together with the piston. The explosive base dosing pump may also be of a piston and cylinder type, and the piston rod of the air motor may be connected to or integral with a pump power input in the form of a piston rod connected to a piston reciprocable in a cylinder in said explosive base dosing pump. Preferably the air motor and dosing pump for explosive base have separate housings which are interconnected together, so that there is an exposed reciprocating link, constituted by the piston rods or extensions thereof, extending between the housings.

The gassing solution dosing pump may also be of a piston and cylinder type, having a piston reciprocable in a cylinder, the piston having a piston rod connected to the link between the housings of the air motor and explosive base dosing pump.

The explosive base dosing pump may be elongated, extending away from its connection to the air motor, and having its inlet at its end remote from the air motor, suitable for immersion in a supply of explosive base to be pumped, held in an open-topped vessel such as a bucket. The gassing solution dosing pump in turn may have a gassing solution- supply vessel connected to its inlet and arranged to feed gassing solution under gravity or suction into said inlet.

Instead, the apparatus may include an explosive base supply hopper to an outlet of which the inlet of the base pump is connected, and a gassing solution supply vessel having an outlet to which the inlet of the gassing solution pump is connected. In this case the apparatus may include a framework on which the pumps and drive motor are mounted, the framework being in the form of a cage having ground-engaging skids whereby the apparatus can be moved over the ground in the fashion of a sled, the hopper and gassing solution supply vessel preferably being mounted in the cage, and the apparatus being movable in the fashion of a sled by one or two persons.

The flexible conduit may lead from the gassing solution pump along the interior of the flexible hose to the lance. The flexible conduit may have an outlet located upstream of and at or adjacent the mixing device, and the flexible conduit may enter the hose adjacent the outlet of the explosive base dosing pump, extending along the interior of the hose towards and into the lance, the outlet or downstream end of the conduit preferably being held concentric with the lance adjacent the mixing device, by a suitable locating device such as a spider, which spaces it radially from the lance wall.

Switch means may be mounted on the lance, the switch means being operatively connected to the drive motor for switching the drive motor on and off. Conveniently, the lance is provided with a pistol grip, on which the switch means is provided in the form of a trigger.

According to another aspect of the invention there is provided a method of loading a sensitized explosive of the slurry or emulsion type into a borehole which comprises

- pumping a non-cap-sensitive explosive base from a supply of said base along a flexible hose by means of a positive displacement reciprocable dosing pump;
- simultaneously pumping a chemical gassing solution for gassing the base from a supply of said gassing solution by means of a positive displacement dosing pump interconnected with and synchronized with the explosive base pump;
- leading the pumped explosive base from the explosive base pump along the flexible hose into a lance connected to the downstream end of the hose and having a mixing device mounted therein; and
- leading the pumped chemical gassing solution along a flexible conduit from the gassing solution pump into the lance upstream of the mixing device, so that the explosive base and gassing solution pass together through the mixing device wherein they are mixed together and subjected to shear, to provide a mixture which issues from the lance, the method including inserting the lance into the borehole while the mixture issues therefrom so that the mixture is loaded into the borehole.

It is contemplated that the method and apparatus will typically be used underground in mines, for loading small diameter [21–50 mm] boreholes with primer-sensitive slurry or emulsion explosive. Thus, non-cap-sensitive or indeed non- primer-sensitive explosive base may be transported underground in portable containers, such as 25 l cans or drums, gassing solution similarly being taken underground in portable containers. Compressed air at 200–700 kPa is often readily available underground in mines, and the portable apparatus may be taken to the site where the boreholes are to be loaded and may be releasably connected to a supply of said compressed air. At the site explosive base can then be decanted into a bucket or the like, and the gassing solution supply vessel can be charged with gassing solution. The lance can then be inserted into a borehole to be charged, and the air motor operated to pump explosive base, which will be a non-sensitized slurry or emulsion base, and gassing solution simultaneously respectively through the hose and conduit, into the lance where they pass together through the mixing device, which may be an orifice plate, non-return valve, static mixer or the like, in which they are thoroughly mixed together and subjected to shear, to form a mixture having increased viscosity relative to that of the explosive base as a consequence cf the shear. As soon as the mixture is formed, its density starts to decrease, by virtue of the formation of gas bubbles arising from the gassing solution. This decrease in density is typically from a value of about 1,40 g/cm$^3$, down to a lower value in the range 1,10 – 1,30 g/cm$^3$, eg 1,15 g/cm$^3$ depending on what is required by the user. The decrease in density typically continues over a period of 15 – 60 minutes, and the mixture which issues from the lance into the borehole after gassing is completed forms a primer-sensitive explosive, or indeed a detonator-sensitive explosive.

It is expected that the explosive base will usually be a suitable water-in-oil or melt-in-oil emulsion having an oxidizing salt-containing component forming a discontinuous phase in a continuous phase which forms a fuel-containing components. In this context an explosive is regarded as non-cap-sensitive if it cannot be detonated in 21 mm diameter with 0,36 g of pentaerythritol tetranitrate [PETN], and as non-primer sensitive if it cannot be detonated in a 210 l [45 gallon] drum by 400 g of Pentalite [ie a mixture of equal proportions by mass Of PETN and TNT [trinitro toluene].

The invention will now be described, by way of example, with reference to the accompanying diagrammatic drawings in which.

Figure 1:
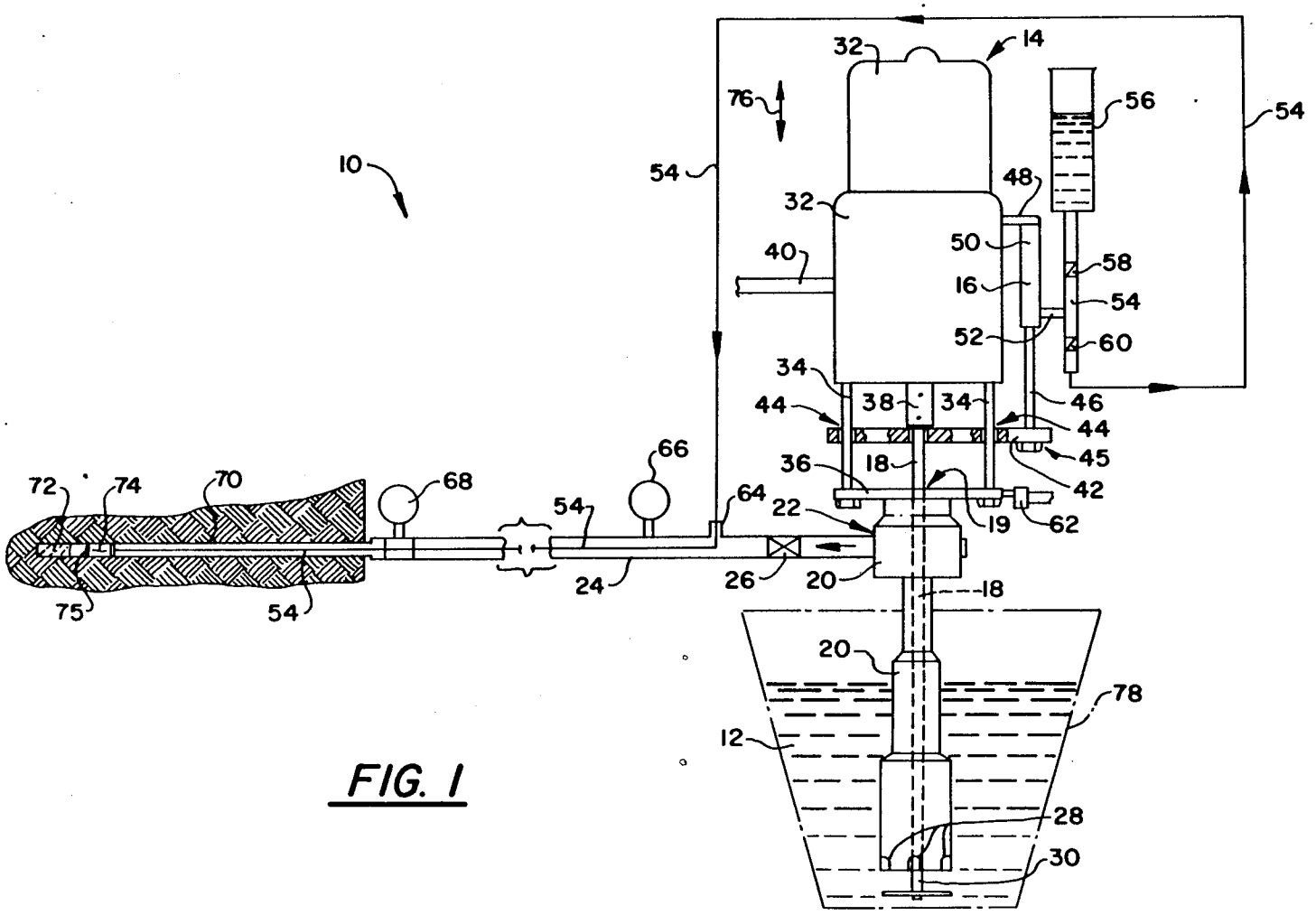
FIG. 1 shows a schematic side elevation of an apparatus in accordance with the invention.

In FIG. 1 of the drawings, apparatus in accordance with the invention is generally designated by reference numeral 10. The apparatus comprises broadly, an emulsion base dosing pump 12, an air motor 14, and a gassing solution dosing pump 16.

The pump 12 is of a reciprocable piston and cylinder type, having a piston slidable within a cylinder within its interior, the piston being connected to a piston rod 18 which at 19 projects outwardly from one end of an elongated cylindrical housing 20 for the pump 12. Adjacent the position where the rod 18 projects from the housing 20, the housing 20 has an outlet at 22 connected to a flexible hose 24 of reinforced plastics or rubber construction, provided, adjacent the outlet 22, with a non-return outlet valve 26. At its end remote from the outlet 22, the housing 20 has a plurality of circumferentially spaced inlet ports 28, and its piston, designated 30, is axially outwardly reciprocable into and out of the housing 20 there.

The air motor 14 has a cylindrical housing 32, which is connected to the end of the housing 20 of the pump 12, from which the rod 18 projects. This connection is by means of a plurality of circumferentially spaced posts 34 projecting downwardly from the housing 32, and bolted to a bracket 36 fast with the housing 20.

The air motor 14 is of a piston and cylinder type, having a piston [not shown] reciprocable in a cylinder [also not shown] in its interior. A piston rod 38 connected to the piston of the motor 14 projects out of the housing 32 in a direction towards the pump 12. The rods 18 and 38 are fast end-to-end with each other, to form extensions of each other. A compressed air supply pipe 40 is shown feeding compressed air into the motor 14.

A beam or shoe 42 is connected to the end of the rod 18 adjacent the connection between the rod 18 and the rod 38. The beam 42 is slidable at 44 along some of the posts 34, and is connected at 45 by a nut to a rod 46, the rod 46 extending parallel to the rods 18, 38 and posts 34, in a direction axially away from the pump 12 to a position alongside the housing 32 of the motor 14.

The dosing pump 16 is mounted alongside the housing 32 of the air motor 14 by means of a bracket 48, and has a cylinder 50 within which a piston [not shown] is reciprocable. The rod 46 is connected to said piston. A pipe 52 extends from the cylinder 50 into a conduit 54 extending downwardly from the bottom of a gassing solution supply vessel 56. The conduit 54 is provided with a pair of non-return valves 58, 60, on opposite sides of the position where the pipe 52 enters the conduit 54. These non-return valves 58, 60 are arranged to permit flow in a direction along the conduit 54 away from and out of the vessel 56.

It will be appreciated in this regard, however, that any functionally similar valve system may be used, such as one employing a suitable slide valve arrangement or a suitable floating head valve arrangement. Indeed, if desired, an entirely separate gassing solution pump may be used, provided that it is adequately synchronized with the dosing pump.

A counter 62 is mounted on the bracket 36, at a position where it is engageable by the nut at 45 at the end of the rod 46.

The conduit 54 is shown entering the hose 24, via a branch 64 of the hose 24, and the conduit 54 extends along the hose 24 in a direction away from the pump 12.

At its end remote from the pump 12, the hose 24 is connected to a lance 70, the lance having a detachable mixing nozzle 72 containing a static mixer [not shown] in its interior. The conduit 54 extends along the interior of the lance 70, and has its downstream end or outlet 74 immediately adjacent and upstream of the nozzle 72, provided with a suitable non-return valve 75, centrally located within the lance, e.g. a non-return valve of the type comprising a plurality of circumferentially spaced ports.

The apparatus 10 will be provided with control means, such as a switch [not shown] mounted on the lance and operable to control air supply along the air supply pipe 40.

In use with reference to FIG. 1, switching on the air supply to the pipe 40 will cause the motor 14 to operate by reciprocating its piston, thereby causing the piston rod 38 to reciprocate, in the direction of arrow 76. This in turn causes the piston rod 18 to reciprocate in the direction of arrow 76, and causes the pump 12 to operate. In use the pump 12 will have its end having the ports 28 immersed in an explosive base such as an emulsion base, contained in an open topped container such as the bucket 78 shown in broken lines in the drawing.

The pump 12 will be of a type which is single-acting, having a working stroke during which it pumps explosive base from the bucket 78 along the hose 24, and a return stroke during which no pumping takes place.

During reciprocation of the rods 18, 38 in the direction of arrow 76, the shoe 42 and rod 46 are also caused to reciprocate in the direction of arrow 76, the bar sliding along the posts 34. This causes the piston in the cylinder 50 of the pump 16 correspondingly to reciprocate, in synchronization therewith.

The pump 16 in turn has a return stroke, during which gassing solution is withdrawn from the vessel 56 via non-return valve 58 and pipe 52 into the cylinder 50, the valve 60 preventing flow of gassing solution from the conduit 54 downstream of the valve 60 into the cylinder 50. During the succeeding working stroke of the piston in the cylinder 50, gassing solution is pumped from the cylinder 50 through the pipe 52 and into the conduit 54 between the valves 58 and 60. The valve 58 prevents flow along the conduit 54 into the vessel 56, but the valve 60 permits flow along the conduit 54 via the valve 60.

The synchronization between the pumps 12 and 16 is such that a working stroke of the pump 12 coincides with a working stroke of the pump 16, so that during such working strokes explosive base flows along the hose 24 and through the lance 70 and nozzle 72, while gassing solution flows along the conduit 54 into the lance 70 and through the nozzle 72. During the succeeding return strokes no flow of base or gassing solution takes place.

As the gassing solution and base flow through the nozzle 72 they are thoroughly mixed together to form a mixture and are subjected to shear. This shear provides the mixture with substantially increased viscosity compared with viscosity of the explosive base, and the mixture is loaded via the lance 70 and nozzle 72 into the borehole being loaded, where it provides a cap-sensitive explosive, e.g. of the water-in-oil emulsion type, after the gassing solution has acted to gas, and thereby sensitize, the explosive base by reducing its density.

It will be appreciated that the end 44 of the rod 46 is arranged to engage the counter 62, once for each working stroke of the apparatus 10, so that the counter 62 counts the number of working strokes performed by the apparatus 10. If desired, this counter can be arranged automatically via suitable control means [now shown], to cut off the air supply along the pipe 40 to the air motor 14, after a predetermined number of working strokes have been completed. The number of working strokes before the air supply is cut off can be adjustable, so that the counter provides a means for adjustably setting the number of working strokes performed, and consequently the amount of explosive loaded, before the air supply is cut off. Instead, the pump may be used without a counter, the explosive loaded being controlled manually based on visual inspection of the hole.

Although the nozzle 72 has been described as having a mixing device in the form of a static mixer, it will be appreciated that a mixing device such as an orifice plate, non-return valve or a combination of such devices can be employed.

The capacity of the pumps 12 and 16 will be matched, so that an appropriate amount of gassing solution is mixed with an appropriate amount of explosive base. Furthermore, the area of the piston in the air motor 14 can be matched with the area of the piston in the pump 12, so that for a particular compressed air supply pressure, the pump 12 will deliver explosive base at a pressure which is increased relative to the air supply pressure by a predetermined factor.

The lance will usually be made of aluminium or copper, but may instead be made of a plastics [polycarbonate] substance, the hose 24 also being made of a non sparking material. The hose may have a length of say 6 m and an inside diameter of about 25 mm, the lance in turn having an inside diameter of about 16 mm and a length of about 1,2 m, including a 200 mm nozzle.

A prototype apparatus of the type described above with reference to the drawing has been tested by the Applicant. The pump was treated with a compressed air supply pressure of 200–400 kPa, and the area of the piston of the pump 12 was 6 times less than the area of the piston of the motor 14, so that the pump 12 could in principle deliver emulsion base at a maximum pressure of about 200–2 400 kPa. The pump was found to have a cycle time [a working stroke or pumping stroke together with the succeeding return stroke] of about 0,35 seconds, when operated empty. When used with the emulsion base described hereunder, it was found to have a cycle time of between 0,40 and 1,60 seconds, depending on the type of mixing device or refining system used in the nozzle 72 [at an air supply pressure of 200–700 kPa], and the pump 12 was found at this air supply pressure to have an outlet pressure of 400–4000 kPa, once again depending on the mixing device employed, the pressure at the inlet to the lance 70 being, correspondingly, about 200–3000 kPa.

The pump 16 in turn delivered a volume of about 1 ml of chemical gassing solution for each working stroke.

The apparatus was tested on a standard repumpable emulsion base to form a mixture having the following composition [after a sodium nitrite chemical gassing solution had been added thereto]:

| Constituent | % by mass |
|---|---|
| Ammonium nitrate | 55,73 |
| Calcium nitrate | 18,33 |
| Water | 18,92 |
| Acetic Acid | 0,09 |
| Thiourea | 0,40 |
| P95 Mineral Oil | 5,50 |
| Crill 43 emulsifier | 1,00 |
| Sodium nitrite | 0,03 |

In the aforegoing the acetic acid is to adjust suitable value for the chemical gassing of about 3,4–3,8; and the thiourea is to catalyze the chemical gassing reaction whereby nitrite ions react with ammonium ions in accordance with the equation:

$$NO_2 + NH_4 \rightarrow N_2 + 2H_2O$$

to produce nitrogen bubbles. The Crill 43 is a sorbitan monooleate emulsifier obtained from Croda Chemicals South Africa [Proprietary] Limited; and the P95 mineral oil is obtainable from BP South Africa [Proprietary] Limited. The proportion of water arising from the chemical gassing solution in which the sodium nitrite is dissolved amounts to 0,13% by mass.

The emulsion base used in the above formulation [ie the above formulation excluding the sodium nitrite and the water introduced together with the sodium nitrite], is a non-capsensitive water-in-oil emulsion. When gassed by the gassing solution comprising 7 parts by weight of sodium nitrite for every 13 parts by mass of water, to a density of 1,15 g/cm$^3$, a primper-sensitive emulsion explosive was obtained. The explosive was found to have an oxygen balance of −1,89, a VOD [velocity of detonation in m/sec] of 4863, a RWS [relative weight strength] of approximately 73,0% ANFO [ammonium nitrate fuel oil], and an RBS [relative breaking strength] of approximately 96,5% ANFO. When gassed, however, to have a density of 1,18 g/cm$^3$, an explosive was obtained having an oxygen balance of −1,89, a VOD of 5014 m/sec, an RWS of 73,3% ANFO and an RBS of 100,2% ANFO.

If desired, the gassing rate can be increased by decreasing the pH of the base emulsion.

The emulsion base [prior to gassing by means of the gassing solution] is in fact primer-insensitive. The viscosity of the emulsion base at 25° C. is 6000–25000 cP, as measured by a Brookfield Model RVT Viscometer using a No. 7 spindle at 50 rpm. The density of the emulsion base is at least 1,40 g/cm$^3$ at 25° C. The stability of the base emulsion is about 4–6 weeks at an average temperature of 30° C., and is expected to be longer at lower temperatures.

The emulsion base has an average discontinuous phase droplet size of about 12 microns.

The method and apparatus of the invention, as described with reference to FIG. 1 of the drawings, were tested using a compressed air supply pressure of 400 kPa, and various mixing devices constituting two or three static mixers arranged in series in the nozzle of the lance or a non-return spring loaded valve in the lance.

In this fashion, using three static mixers [SMX mixers available in South Africa from Sulzer [Proprietary] Limited] an explosive having a density of 1,0 g/cm$^3$ was obtained after 24 hours with the abovementioned sodium nitrite gassing solution. In this case viscosity was increased by the mixing from a value of 16853 cP for the emulsion base at 24° C., measured as described above, to a viscosity of about 27000 cP at 24° C. for the fully gassed explosive.

When a non-return valve was used as the mixing device, a gassed explosive having a viscosity of 60000 cP was obtained having a density of 1,15 g/cm$^3$ after 24 hours at 24° C. for the same gassing solution. This period has been reduced to less than 1 hr in later tests.

When two SMV static mixers [available in South Africa from Sulzer [Proprietary] Limited] employed in series were used, a maximum viscosity of 44500 cP and a density of 1,21 g/cm$^3$ could be obtained after less than 1 hour at 24° C. as above. Mixing however appeared to be incomplete.

Figure 2:
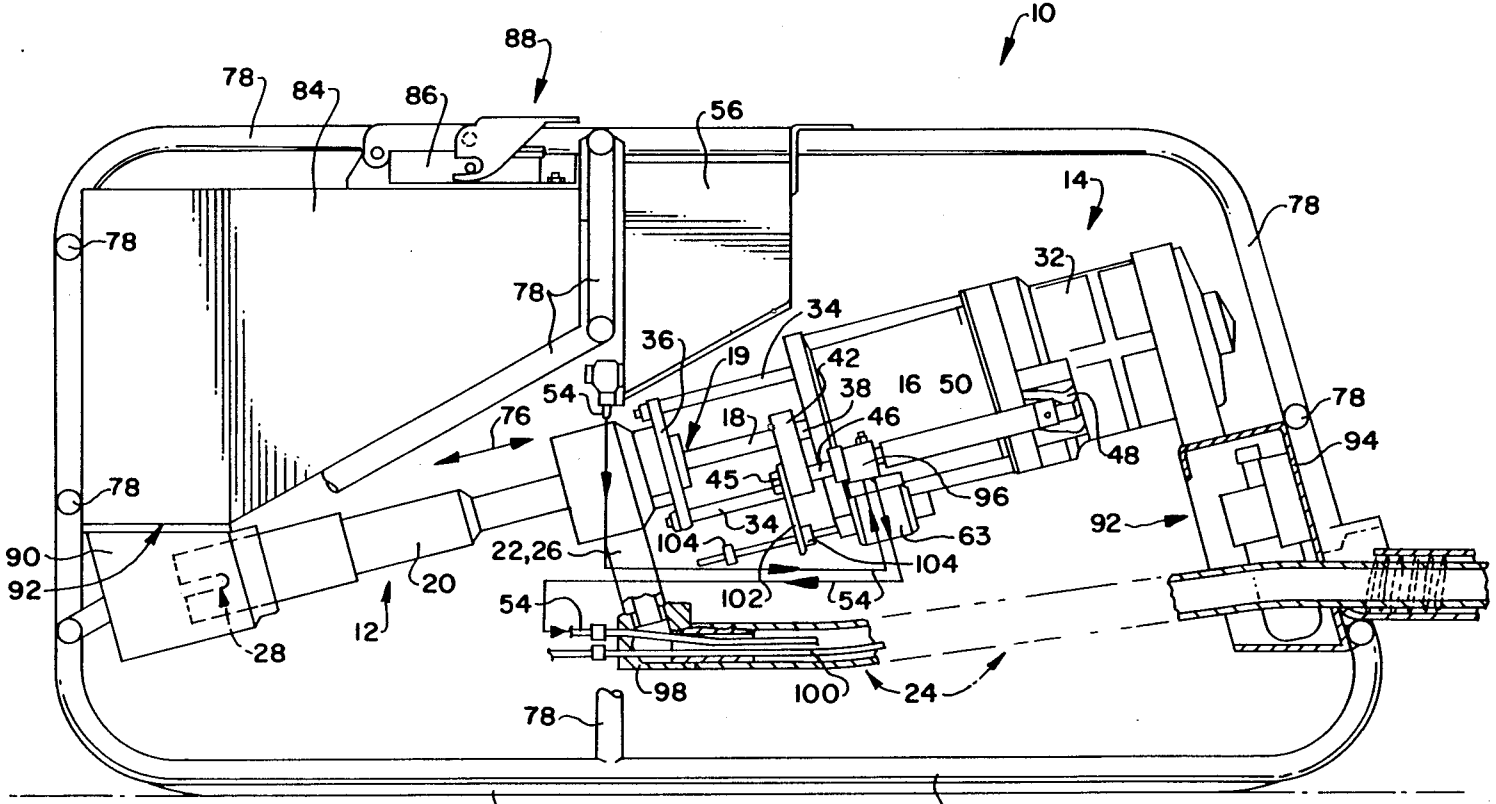
FIG. 2 shows a similar view of a more sophisticated version of the apparatus in accordance with the invention.

Turning now to FIG. 2 of the drawings, the same reference numerals are used for the same parts, unless otherwise specified.

Major differences between FIG. 2 and FIG. 1, are that the apparatus 10 of FIG. 2 is mounted on a framework comprising pipes 78 arranged to form a cage within which the various parts of the apparatus 10 are mounted. The cage is elongated in side elevation, and comprises a pair of laterally spaced lowermost horizontal parallel pipes 80, one of which is visible in FIG. 2, which are provided with downwardly directed ground-engaging skids 82.

Instead of the bucket 78 and the vessel 56 shown in FIG. 1, a more or less permanent explosive base hopper 84 is shown in FIG. 2, mounted in the cage, together with a similar metal or plastics gassing solution vessel 56. The hopper 84 is shown with an upwardly directed charging opening 86 at its top, provided with a hinged lockable closure 88.

The pump 12 and motor 14, instead of being vertically oriented with the motor 14 uppermost, are oriented at a shallow angle to the horizontal, once again with the motor 14 uppermost. The pump 12 is shown with its inlet located in a discharge chute 90 connected to a lower outlet 92 from the hopper 84.

More particularly, the outlet 22 of the pump 12 is provided by a short length of pipe containing the non-return outlet valve 26. In FIG. 2 the piston of the pump 12 is not shown, being withdrawn into the housing of the pump 12 unlike the situation in FIG. 1 where the piston 30 is shown projecting outwardly of the housing of the pump 12.

The compressed air supply pipe [40 in FIG. 1] is omitted from FIG. 2, and, instead, compressed air switching means connected directly to the motor 14 for controlling the air supply thereto is shown at 92, mounted, together with an air line filter and lubricator, in a protective bracket 94.

Furthermore, in FIG. 2, the pipe 52 is not shown individually, and the valves 58, 60 of FIG. 1 are replaced by a slide valve 63, in communication at 96 with the dosing pump 16. The flexible conduit 54 is shown diagrammatically, where it extends from the vessel 56 to the pump 16 at 96, and thence to the upstream end of the hose 24 which is connected to the outlet pipe 22 of the pump 12. The function of the conduit 54, and of slide valve 63 connected at 96 to the pump 16 is substantially the same as that of the conduit 54, pipe 52 and valves 58, 60 in FIG. 1.

Instead of entering the hose 24 via a branch [64 in FIG. 1] the conduit 54 enters axially into the upstream end of the hose 24, via an elbow 98 connected to the pipe 22. A pair of compressed air control lines, one of which is shown at 100 in FIG. 2, extend from the switching device 92, together with the conduit 54, along the interior of the hose 24 to the lance, as described in more detail hereunder with reference to FIG. 3.

It will also be noted in FIG. 2 that the nut 45 is attached to a bracket 102 engagable with two stops 104 forming part of the slide valve.

In FIG. 2 the pressure gauges 66, 68 of FIG. 1 are not shown.

Figure 3:
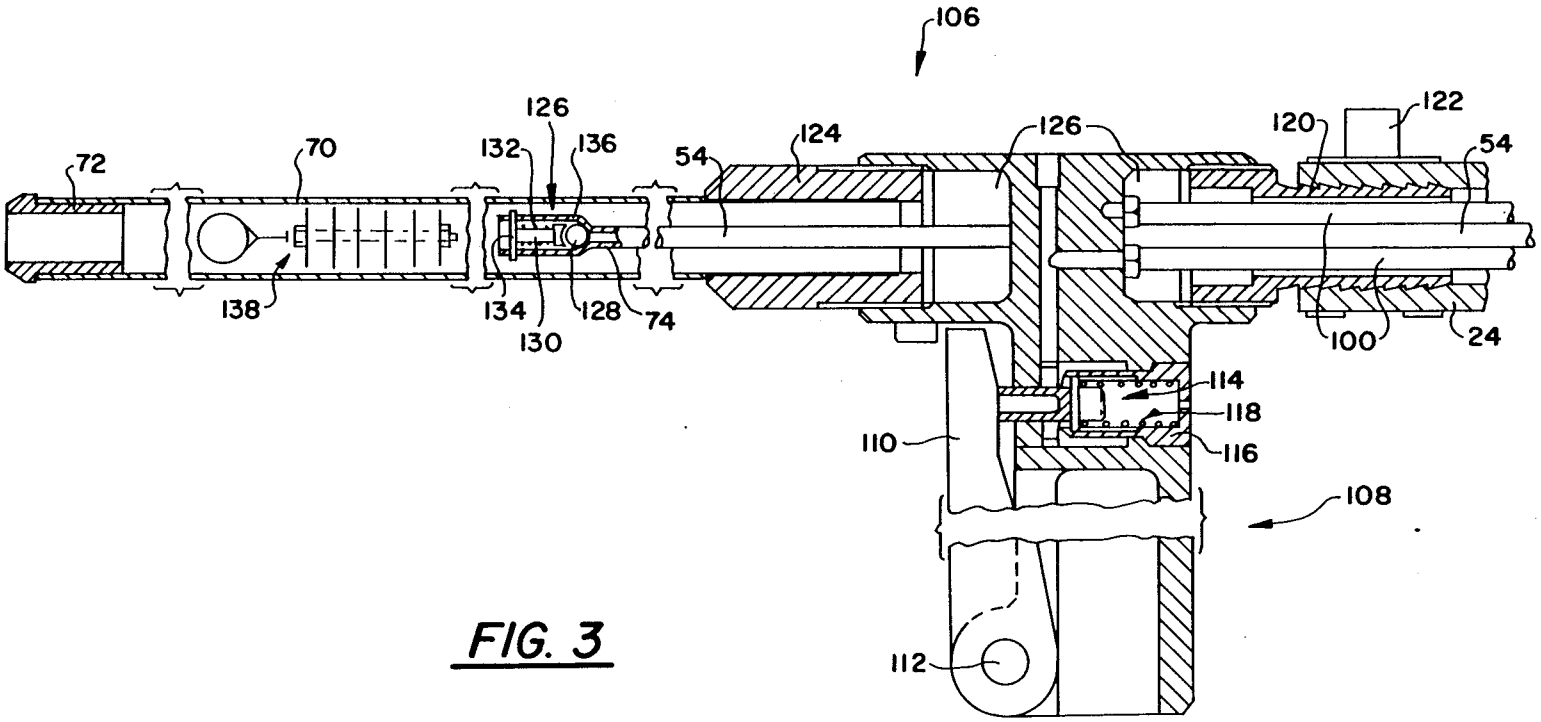
FIG. 3 shows a detail in sectional side elevation of the lance of the apparatus of FIG. 2.

Turning to FIG. 3, the arrangement of the lance 70 at the end of the hose 24 is generally designated 106. Once again, unless otherwise specified, like reference numerals refer to like parts.

In FIG. 3 the lance 70 is shown provided with a pistol grip generally designated 108 provided with a trigger 110 pivotally connected thereto at 112. The trigger 110 is connected to a shut-off valve 114 operable within a valve body 116 located in the pistol grip 108, and spring biassed by a coil spring 118 to its closed position. The valve 1 14 operates on the compressed air control lines 100.

The hose 24 is shown connected to the grip 108 by means of a serrated spigot 120 fast with the grip 108 and a hose clamp 122. A threaded end piece 124 on the lance 70 connects the pistol grip to the lance 70, which is placed in communication with the hose 24 via a passage 126 through the interior of the pistol grip 108.

At the downstream end of the flexible conduit 54 there is provided a non-return valve 126, having a ball 128 biassed by a spool 130 engaged, by a coil spring 132 under compression, to its closed position, the coil spring 132 engaging a stop 134 at the end of the valve body 136 remote from the conduit 54. The valve body 136 is of the type having a plurality of, e.g. 6, equally circumferentially spaced outlet openings and the valve 126 is held concentrically in the lance by means of a spider. Downstream of the non-return valve 126 a static mixer, generally designated 138, is mounted in the lance 70, and the nozzle 72 of the lance 70 is a simple outlet nozzle and not a mixing nozzle.

From the aforegoing it will be noted that, while the apparatus 10 of FIGS. 2 and 3 demonstrates a number cf refinements compared with the apparatus 10 of FIG. 1, its construction and function are broadly essentially similar. In use, the lance is inserted into a borehole to be loaded, and the pumps 12, 16 are activated by means of the trigger 110 on the pistol grip 108. This permits compressed air passing along the passages 100 to operate the switching means 92, to set the air motor 14 into operation. After a desired number of strokes of the pump 12, ie when the borehole has been charged, the trigger 110 is released to discontinue pumping.

It will be appreciated that a particular advantage of the construction shown in FIG. 2 is the provision of the cage of pipes 78, of a relatively low height, to facilitate movement thereof adjacent stopes to be blasted, in mines, having relatively low hanging walls. Movement is further facilitated by the provision of the skids 82 for movement of the apparatus in the fashion of a sled. Furthermore, the pistol grip arrangement for the lance shown in FIG. 3 facilitates actual loading of boreholes.

Another particular advantage of the invention is that the method and apparatus can be operated by a compressed air supply having a pressure as low as 200 kPa.

Finally, it is to be noted that the Applicant carried out a number of tests at various densities of sensitized emulsion, using the base emulsion and gassing solution specified above. Unconfined tests were carried out in PVC pipes of diameter ranging from 28–100 mm at an emulsion density of 1,16 g/cm$^3$; and confined tests were carried out in steel pipes of diameter 26,7 mm and at various emulsion densities varying from 1,10–1.28 g/cm$^3$. Velocities of detonation of 3500–5000 m/sec were obtained; the critical unconfined diameter was found to be somewhat more than 50 mm; the critical confined diameter was found to be less than 26,7 mm; and the critical confined density was found to be about 1,28 g/cm$^3$. Double pipe tests using 50 mm water-filled witness pipes indicated that full coupling took place. Several mine trials amounting to more than 1000 shots were successful in 27–38 mm holes of 1,2 m length at a product density of about 1,25 g/cm$^3$, with good fragmentation and few sockets.

We claim:

1. A mobile apparatus for loading a sensitized explosive of the slurry or emulsion type into a borehole, the apparatus comprising a reciprocable positive displacement explosive base dosing pump having an inlet for explosive base;

a drive motor drivingly connected to the pump;

a flexible hose connected to an outlet of the dosing pump;

a lance connected to the end of the hose remote from the pump;

a mixing device mounted in the lance for subjecting fluid passing therethrough to mixing and shear;

a reciprocable positive displacement chemical gassing solution dosing pump having an inlet for chemical gassing solution, the gassing solution pump being operatively connected to the base pump for synchronous operation therewith; and a flexible conduit connected to an outlet of the gassing solution pump and leading to the lance into which it feeds at a position upstream of the mixing device.

2. An apparatus as claimed in claim 1, in which the drive motor is a fluid-driven motor.

3. An apparatus as claimed in claim 1, which includes an explosive base supply hopper to an outlet of which the inlet of base pump is connected.

4. An apparatus as claimed in claim 1, which includes a framework on which the pumps and drive motor are mounted, the framework being in the form of a cage having ground-engaging skids whereby the apparatus can be moved over the ground in the fashion of a sled.

5. An apparatus as claimed in claim 1, in which the flexible conduit leads from the gassing solution pump along the interior of the flexible hose to the lance.

6. An apparatus as claimed in claim 1, in which switch means is mounted on the lance, the switch means being operatively connected to the drive motor for switching the drive motor on and off.

7. A method of loading a sensitized explosive of the slurry of emulsion type into a borehole which comprises pumping a non-cap-sensitive explosive base from a supply of said base along a flexible hose by means of a positive displacement reciprocable dosing pump;

simultaneously pumping a chemical gassing solution for gassing the base from a supply of said gassing solution by means of a positive displacement dosing pump interconnected with and synchronized with the explosive base pump;

leading the pumped explosive base from the explosive base pump along the flexible hose into a lance connected to the downstream end of the hose and having a mixing device mounted therein; and leading the pumped chemical gassing solution along a flexible conduit from the gassing solution pump into the lance upstream of the mixing device, so that the emulsion base and gassing solution pass together through the mixing device wherein they are mixed together and subjected to shear, to provide a mixture which issues from the lance, the method including inserting the lance into the borehole while the mixture issues therefrom so that the mixture is loaded into the borehole.

* * * * *

UNITED STATES PATENT AND TRADEMARK OFFICE

CERTIFICATE OF CORRECTION

PATENT NO. : 4,966,077

DATED : October 30, 1990

INVENTOR(S) : HALLIDAY ET AL

It is certified that error appears in the above-identified patent and that said Letters Patent is hereby corrected as shown below:

In Column 3, line 42, "Pentalite should be --Pentolite--.

In Column 6, line 55, "3,4-3,8" should be --pH 3,4-3,8--.

In Column 7, lines 10-11, "breaking" should be --bulk--.

In Column 10, claim 7, line 2, "of" should be --or--.

In Column 6, line 54, after "adjust" insert --the pH to a--.

Signed and Sealed this

Seventeenth Day of November, 1992

*Attest:*

DOUGLAS B. COMER

*Attesting Officer*

*Acting Commissioner of Patents and Trademarks*